US006828497B2

(12) United States Patent
Yataka et al.

(10) Patent No.: US 6,828,497 B2
(45) Date of Patent: Dec. 7, 2004

(54) ELECTRONIC KEYBOARD INSTRUMENT AND TONE REPRODUCTION METHOD THEREFOR

(75) Inventors: Koji Yataka, Hamakita (JP); Tomomitsu Urai, Hamamatsu (JP); Akira Miki, Hamamatsu (JP); Fukushi Kawakami, Hamakita (JP); Shinichi Sawara, Kosai (JP)

(73) Assignee: Yamaha Corporation, Hamamatsu (JP)

( * ) Notice: Subject to any disclaimer, the term of this patent is extended or adjusted under 35 U.S.C. 154(b) by 55 days.

(21) Appl. No.: 10/329,025

(22) Filed: Dec. 24, 2002

(65) Prior Publication Data

US 2003/0121402 A1 Jul. 3, 2003

(30) Foreign Application Priority Data

Dec. 28, 2001 (JP) ..... 2001-400384

(51) Int. Cl.[7] ..... G10H 7/00

(52) U.S. Cl. ..... 84/625; 84/DIG. 16; 84/DIG. 27; 381/118

(58) Field of Search ..... 381/118; 84/626, 84/662, 665, 667, 633, 635, DIG. 16, DIG. 27, 625

(56) References Cited

U.S. PATENT DOCUMENTS 5,031,500 A * 7/1991 Koike et al. ..... 84/600
5,247,129 A * 9/1993 Nozaki et al. ..... 84/615
6,157,724 A 12/2000 Kawakami
6,392,136 B2 * 5/2002 Kondo et al. ..... 84/718
6,479,742 B1 * 11/2002 Torii et al. ..... 84/724

FOREIGN PATENT DOCUMENTS

DE 3424754 1/1986

* cited by examiner

*Primary Examiner*—Jeffrey W. Donels
(74) *Attorney, Agent, or Firm*—Pillsbury Winthrop LLP

(57) ABSTRACT

On a casing of an electronic keyboard instrument, there are provided front speakers, rear speakers and upper speakers as non-front speakers, a woofer speaker, and a vibrator. Tone generator section generates tone signals of tone colors corresponding to tones of various musical instruments. Assignment section adjusts, on a tone-color-by-tone-color basis, tone volume allocations, of the generated tone signals, to the speakers and vibrator. Further, the thus-adjusted tone signals are mixed for each of speaker reproduction systems and vibrator drive system, and then the resultant mixed tone signals of the speaker reproduction systems and vibrator drive system are supplied to corresponding ones of the speakers and vibrator.

14 Claims, 2 Drawing Sheets

ELECTRONIC KEYBOARD INSTRUMENT AND TONE REPRODUCTION METHOD THEREFOR

BACKGROUND OF THE INVENTION

The present invention relates generally to electronic keyboard instruments capable of generating tones of a plurality of tone colors and tone reproduction methods for use with the electronic keyboard instruments, and more particularly to an improved electronic keyboard instrument and tone reproduction method therefor which can create or set up feelings or senses of expansion, depth, etc. of tones separately for each tone color selectable on the electronic keyboard instrument and thereby faithfully reproduce characteristics of tones of various types of natural musical instruments.

Among various conventionally-known electronic keyboard instruments capable of generating tones of a plurality of tone colors (timbres) is one which individually assigns tone signals of various tone colors to reproduction systems of left and right channels and then audibly reproduces the assigned tone signals through left and right speakers after imparting a desired effect, such as reverberation, to the tone signals.

Although the above-mentioned conventional electronic keyboard instrument can set sound image localization, in a horizontal direction, (i.e., horizontal sound image localization) of tones for each tone color selectable on the instrument, it can not create or set up feelings or senses of expansion, depth, etc. of tones separately for each of the selectable tone colors, so that it can not reproduce characteristics of tones of various types of natural musical instruments.

SUMMARY OF THE INVENTION

In view of the foregoing, it is an object of the present invention to provide an improved electronic keyboard instrument and tone reproduction method therefor which can set up senses of expansion, depth, etc. of tones separately for each tone color selectable on the instrument and thereby faithfully reproduce characteristics of tones of various types of natural musical instruments.

In order to accomplish the above-mentioned object, the present invention provides a tone reproduction method for an electronic keyboard instrument, which comprises the steps of: providing a front speaker in an orientation facing a human player and a non-front speaker in an orientation not facing the human player; setting tone volume allocations to be applied to the individual speakers, separately for each of a plurality of tone source channels that generate tone signals of respective tone colors; assigning the tone signals of the individual tone source channels to respective reproduction systems of the speakers, with the tone volume allocations set by the step of setting; and mixing the assigned tone signals of the individual tone source channels, separately for each of the reproduction systems of the speakers and audibly reproducing the mixed tone signals via corresponding ones of the speakers.

With the present invention thus arranged, it is possible to create or set up senses of depth and expansion of tones by increasing the tone volume allocations to the non-front speaker. Further, by setting appropriate channel-by-channel tone volumes to be allocated (i.e., tone volume allocations) to the non-front speaker relative to channel-by-channel tone volume allocations to be applied to the front speaker for each of the tone colors selectable on the instrument (namely, generatable by the tone generator section of the instrument), the present invention can set up senses of depth, expansion, etc. of tones for each of the selectable tone colors and thereby faithfully reproduce characteristics of tones of various types of natural musical instruments.

According to another aspect of the present invention, there is provided an electronic keyboard instrument which comprises: a front speaker provided in an orientation facing a human player; a non-front speaker provided in an orientation not facing the human player; a tone generator section that generates tone signals of respective tone colors through a plurality of tone source channels; an assignment section that assigns the tone signals of the individual tone source channels to respective reproduction systems of the speakers, with tone volume allocations set individually for the reproduction systems; and a mixing section that mixes the assigned tone signals of the individual tone source channels, separately for each of the reproduction systems of the speakers and supplies the mixed tone signals to corresponding ones of the reproduction systems of the speakers.

In the electronic keyboard instrument of the present invention, the front speaker may include left and right front speakers provided on a front surface of a casing of the electronic keyboard instrument. In this case, it is possible to set horizontal sound image localization for each of the selectable tone colors, by setting tone volume allocations to be applied to the left and right front speakers for each of the selectable tone colors.

Further, the non-front speaker may include a rear speaker provided on a rear surface of the casing and facing rearwardly of the electronic keyboard instrument. By increasing tone volume allocations to the rear speaker, it is possible to particularly enhance a sense of depth of generated tones. Also, it is possible to set a sense of depth of generated tones for each of the selectable tone colors, by setting tone volume allocations to the rear speaker for each of the selectable tone colors (i.e., on a tone-color-by-tone-color basis). For example, increasing the tone volume allocations to the rear speaker in relation to a piano tone color can create a sense of depth of generated tones in much the same way as in a real grand piano. The rear speaker may comprise left and right rear speakers, for example.

The non-front speaker may include an upper speaker provided on an upper surface of the casing and facing upwardly of the electronic keyboard instrument. By increasing tone volume allocations to the upper speaker, it is possible to particularly enhance a sense of expansion of generated tones. Also, it is possible to set a sense of expansion for each of the selectable tone colors, by setting tone volume allocations to the upper speaker for each of the selectable tone colors. For example, increasing the tone volume allocations to the upper speaker in relation to a flute tone color can create a sense of expansion of flute tones. The upper speaker may comprise left and right upper speakers, for example.

The electronic keyboard instrument of the present invention may further comprise a woofer speaker provided in an orientation facing the human player. In this case, the assignment section may assign the tone signals of the individual tone source channels to a reproduction system of the woofer speaker with tone volume allocations individually set for the reproduction system of the woofer speaker, and the mixing section may mix the tone signals assigned to the reproduction system of the woofer speaker and supply the resultant mixed tone signals to the reproduction system of the woofer speaker. In this case, it is possible to set tone volume allocations to the woofer speaker for each of the selectable tone colors, and thus, by increasing the tone volume allocations to the woofer speaker for a particular musical instrument tone including low-frequency components, the particular musical instrument tone can be reproduced in a realistic manner.

The electronic keyboard instrument of the present invention may further comprise a storage section that, for each tone color generatable by the tone generator section, stores tone volume allocations of tone signals to be applied to individual ones of the reproduction systems of the speakers. In this case, for each of the tone source channels generating tone signals of respective tone colors, the assignment section read outs the stored tone volume allocations to be applied to the individual reproduction systems of the speakers, from the storage section, in response to a predetermined readout instruction, and then sets the read-out tone volume allocations as the tone volume allocations to be applied to the individual reproduction systems of the speakers. The electronic keyboard instrument may further comprise a tone-volume-allocation modification section that modifies, separately for each designated one of the tone source channels, the tone volume allocations set in the assignment section in response to predetermined modifying operation by a user. Namely, in this case, the modified tone volume allocations may be stored in the storage section, so that the assignment section can read out the stored tone volume allocations from the storage section in response to a readout instruction upon powering-on of the musical instrument or at any other appropriate time and then set the individual speaker reproduction systems to the read-out tone volume allocations.

The electronic keyboard instrument of the present invention may further comprise a vibrator provided on a casing of the electronic keyboard instrument. In this case, the assignment section assigns the tone signals of the individual tone source channels to a drive system of the vibrator with tone volume allocations separately set for the drive system of the vibrator, and the mixing section mixes the assigned tone signals of the individual tone source channels and supplies the mixed tone signals to the drive system of the vibrator. Thus, driving the vibrator with the tone signals can vibrate the casing of the instrument, and depending on the position of the vibrator, vibrations of the vibrator can be transmitted to the floor to cause vibrations of the floor. For example, by driving the vibrator with tone signals having a tone color of a particular musical instrument, such as a piano, contrabass or cello, whose vibrations are usually transmitted to the floor of a performing stage, a performance of the musical instrument can be reproduced in a realistic manner. Note that the vibrator drive system may be arranged to particularly extract low-frequency components of the tone signals.

The electronic keyboard instrument of the present invention may further comprise a tone parameter impartment section that imparts respective predetermined tone parameters to the tone signals of the individual tone source channels. In this case, the assignment section assigns the tone signals of the individual tone source channels, having been imparted with the respective predetermined tone parameters by the tone parameter impartment section, to the corresponding reproduction systems of the speakers with the tone volume allocations set individually for the reproduction systems of the speakers. Note that the predetermined tone parameters to be imparted to a tone signal of each of the tone source channels may include parameters of any one or more of a frequency characteristic, delay time and reverberation characteristic.

The electronic keyboard instrument of the present invention may further comprise a second tone parameter impartment section that imparts respective predetermined tone parameters to the tone signals of the individual reproduction systems of the speakers having been mixed by the mixing section. In this case too, the predetermined tone parameters to be imparted to a tone signal of each of the tone source channels may include parameters of any one or more of a frequency characteristic, delay time and reverberation characteristic. With this arrangement, desired tone characteristics can be set separately for each of the speaker reproduction systems. The electronic keyboard instrument of the present invention may further comprise a tone volume adjustment section that individually adjusts tone volumes of the tone signals of the reproduction systems of the speakers having been mixed by the mixing section.

The following will describe embodiments of the present invention, but it should be appreciated that the present invention is not limited to the described embodiments and various modifications of the invention are possible without departing from the basic principles of the invention. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Figure 2A:
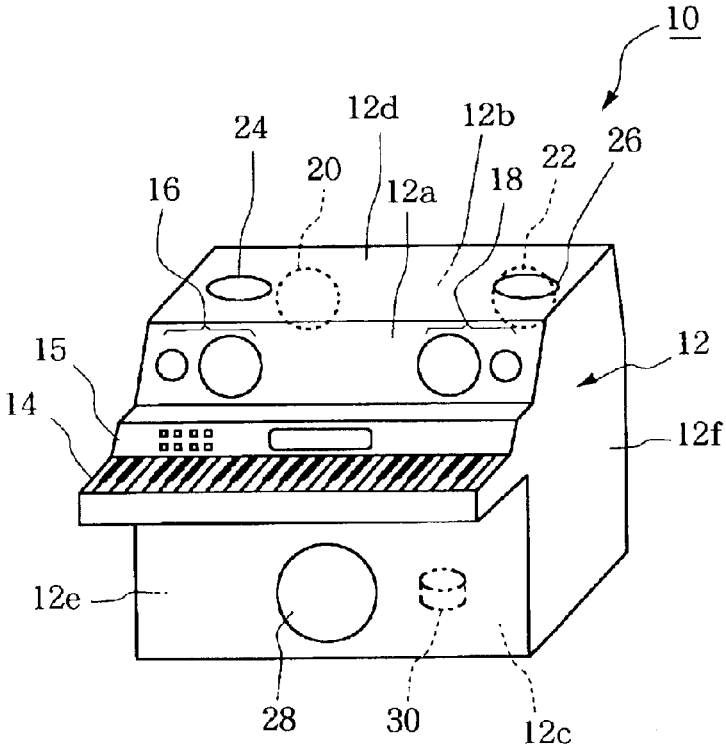
FIG. 2A is a perspective view showing a general external appearance of the electronic keyboard instrument of FIG. 1.
Figure 2B:
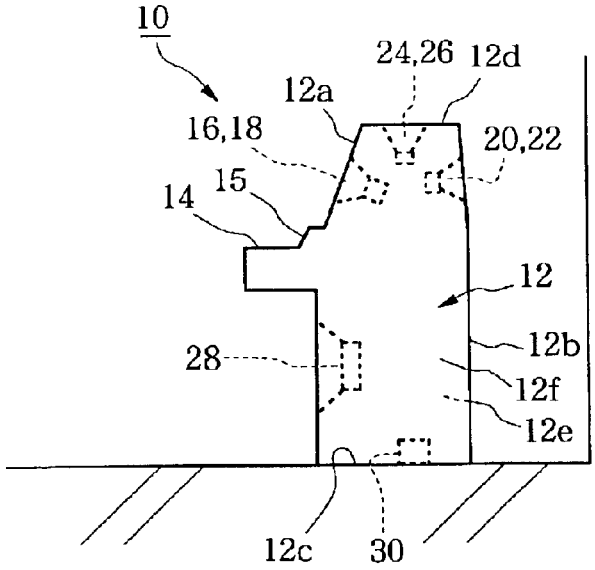
FIG. 2B is a side view of the electronic keyboard instrument.

FIG. 2A is a perspective view showing a general external appearance of an electronic keyboard instrument 10 in accordance with an embodiment of the present invention, and FIG. 2B is a side view of the electronic keyboard instrument. As shown, the electronic keyboard instrument 10 includes a keyboard 14 and an operation panel 15 provided on a front side of a casing 12. On left and right areas of a front surface 12*a* of the casing 12 above the keyboard 14, there are provided left and right front speakers 16 and 18 in such an orientation that their respective sounding surfaces face a human player. On left and right areas of a rear surface 12*b* of the casing 12, there are provided left and right rear speakers 20 and 22 in such an orientation that their respective sounding surfaces face rearward or face away from the human player. Further, on left and right areas of an upper surface 12*d* of the casing 12, there are provided left and right upper speakers 24 and 26 in such an orientation that their respective sounding surfaces face upward. Below the keyboard 14, a woofer speaker 28 is provided on a horizontally (i.e., widthwise) middle area of the front surface 12*a* of the casing 12. Furthermore, a vibrator 30 is provided at a given position within the casing 12, e.g. on a bottom plate 12*c* of the casing 12.

Figure 1:
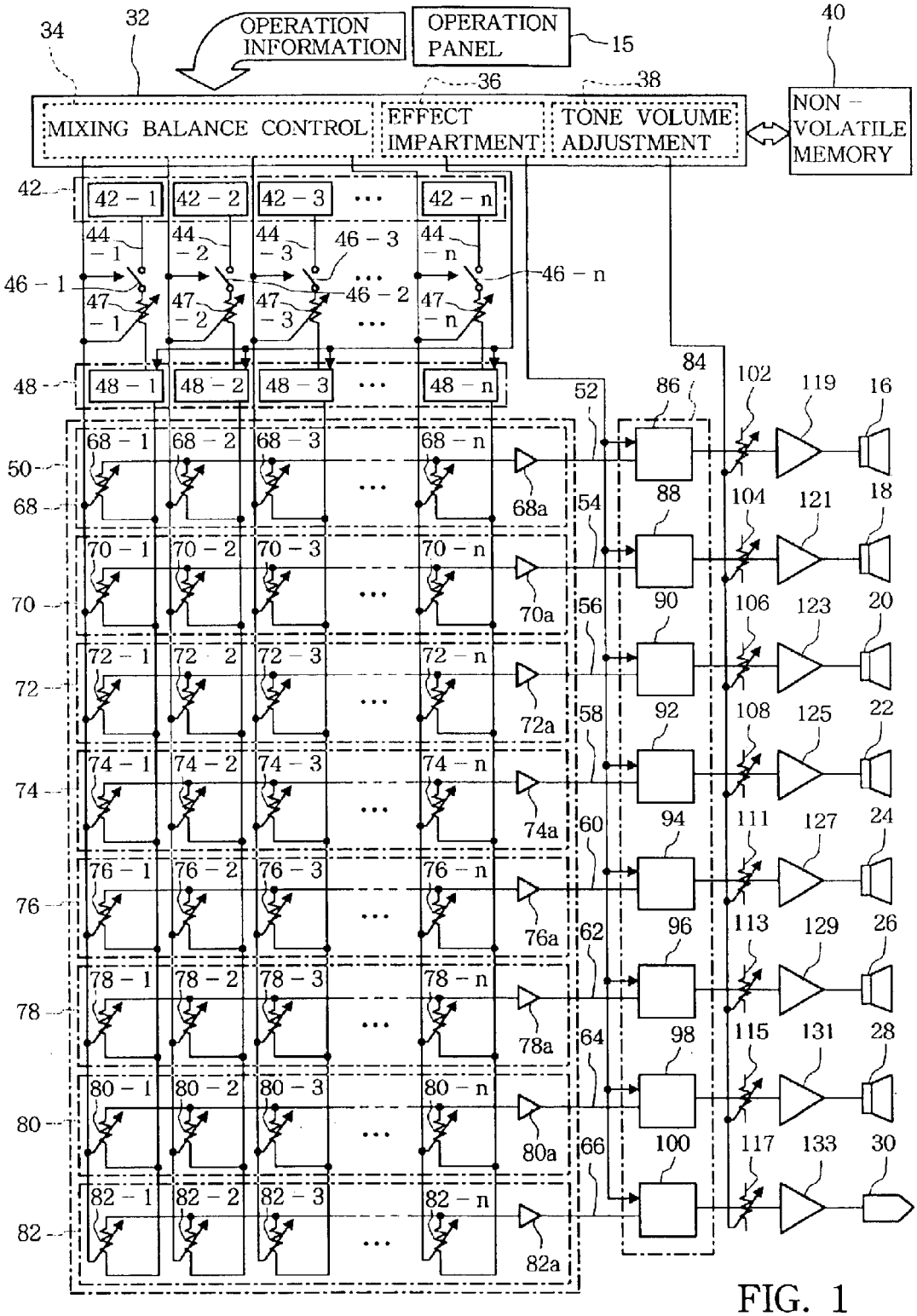
FIG. 1 is a block diagram showing a general setup of electric circuitry employed in an electronic keyboard instrument in accordance with an embodiment of the present invention.

FIG. 1 is a diagram showing a general setup of electric circuitry employed in the electronic keyboard instrument 10. Via the operation panel 15, a user (e.g., human player) of the keyboard instrument 10 can perform: ON/OFF setting operation for each tone color (e.g., for each of various types of musical instruments) selectable on the electronic keyboard instrument 10 (namely, for each tone color generatable by a tone generator section of the instrument 10); tone-parameter setting operation to set tone parameters (parameters of frequency characteristics, delay time, reverberation characteristics, etc.) for each of the selectable tone colors, tone-volume-allocation setting operation to set respective tone volume allocations (i.e., tone volumes to be allocated) to the speakers and vibrator (in the case of the vibrator, vibration amount allocation) for each of the selectable tone colors; tone-volume adjusting operation to adjust a tone volume for each desired one of the selectable tone colors; tone-parameter setting operation to set tone parameters (parameters of frequency characteristics, delay time, reverberation characteristics, etc.) for each of speaker reproduction systems and vibrator drive system; tone-volume adjusting operation to adjust a tone volume for each desired one of the speaker reproduction systems and vibrator drive system (in the case of the vibrator drive system, amount of vibration); and total-tone-volume adjusting operation to adjust a total tone volume of all tones to be audibly reproduced at a time (including a vibration amount of the vibrator).

Each piece of operation information generated by the operation panel 15 is passed to an interface control unit 32. In the interface control unit 32, a mixing balance control section 34 performs, on the basis of user's ON/OFF setting operation for each of the selectable tone colors, ON/OFF control of a tone source unit corresponding to the selectable tone color. Also, on the basis of user's tone-volume-allocation setting operation to set tone volume allocations to be applied to the speakers and vibrator for each of the selectable tone colors, the mixing balance control section 34 controls tone volume allocations of tone signals of the selectable tone color to the corresponding speakers and vibrator. Further, on the basis of user's tone-volume adjusting operation for each desired one of the selectable tone colors, the mixing balance control section 34 performs tone volume adjustment control for that desired tone color. Further, an effect impartment section 36 of the operation panel 15 performs, on the basis of user's tone-parameter setting operation to set tone parameters for each of the selectable tone colors, tone parameter impartment control to impart tone parameters (parameters of frequency characteristics, delay time, reverberation characteristics, etc.) to tone signals of the selectable tone color. Furthermore, on the basis of user's tone-parameter setting operation to set tone parameters for each of the speaker reproduction systems and vibrator drive system, the effect impartment section 36 performs tone parameter impartment control to impart tone parameters (parameter of frequency characteristics, delay time, reverberation characteristics, etc.) to tone signals to be supplied to the corresponding speaker reproduction systems and vibrator drive system. Further, a tone volume adjustment section 38 performs, on the basis of user's operation to adjust tone volumes for each desired one of the speaker systems and vibrator drive system, tone volume adjustment control of the desired speaker reproduction system or vibrator drive system. Furthermore, on the basis of user's operation to adjust a total tone volume of all tones to be audibly reproduced at a time, the tone volume adjustment section 38 performs tone volume adjustment control of all of the speaker reproduction systems and vibrator drive system.

Further, in the electronic keyboard instrument 10 of FIG. 1, a non-volatile memory 40, which comprises, for example, an EPROM, has prestored therein various settings, such as: respective tone volume allocations to the speakers and vibrator for each of the selectable tone colors; respective tone parameters for the selectable tone colors; respective sets of tone parameters for the speaker reproduction systems and vibrator drive system; and respective tone volume adjustment values for the speaker reproduction systems and vibrator drive system. Upon powering-on of the electronic keyboard instrument 10, the prestored settings of various parameters are read out from the non-volatile memory 40 and set in the corresponding sections of the instrument 10, so that the entire electronic keyboard instrument 10 is restored to its settings immediately before last powering-off of the keyboard instrument 10. Once the user has performed operation to modify any of the parameter settings, the corresponding stored contents of the non-volatile memory 40 are updated accordingly, automatically or in accordance with user's storing operation.

Note that default values of the parameters, previously determined by a manufacturer of the electronic keyboard instrument 10, may be prestored in a ROM or the like so that the parameters are set to their respective default values the first time the keyboard instrument 10 is used by the user. In this case, the user is allowed to modify the default value of any of the parameters, and the thus-modified value can be stored in the non-volatile memory 40 automatically or by user's storing operation. Even after the modification, the parameter in question can be restored to the default value by user's resetting operation or the like.

Further, in the electronic keyboard instrument 10, a tone generator section 42 includes a plurality of tone source units 42-1, 42-2, . . . , **42-*n* for generating tone signals of various tone colors (i.e., tone colors of various natural musical instruments), each of which may be in the form of a sampling sound source. The tone source units 42-1, 42-2, . . . , 42-*n* are designed to generate tone signals in response to performance operation by the human player or in accordance with an automatic performance program stored in a storage medium such as a ROM, and sends the thus-generated tone signals to corresponding ones of a plurality of tone source channels 44-1, 44-2, . . . , 44-*n*. A plurality of switches 46-1, 46-2, . . . , 46-*n*, provided in corresponding relation to the tone source units 42-1, 42-2, . . . , 42-*n*, are each turned on or off by user's ON/OFF setting operation for each of the selectable tone colors; that is, each of the switches 46-1, 46-2, . . . , 46-*n* passes therethrough the tone signal of the corresponding tone source channel when the corresponding tone color is set to the ON state (i.e., selected) by the user, but blocks the tone signal of the corresponding tone source channel when the corresponding tone color is set to the OFF state (i.e., not selected) by the user. The tone signal of each of the tone source channels 44-1, 44-2, . . . , 44-*n* is supplied to a corresponding one of attenuators 47-1, 47-2, . . . , 47-*n*, where the supplied tone signal is subjected to tone volume control based on user's tone volume adjusting operation for each of the selectable tone colors. First tone parameter impartment section 48 includes a plurality of tone parameter imparting units 48-1, 48-2, . . . , 48-*n* provided in corresponding relation to the tone source channels 44-1, 44-2, . . . , 44-*n*. In the tone parameter impartment section 48, the tone signal of each of the tone source channels 44-1, 44-2, . . . , 44-*n* is imparted with tone parameters, such as parameters of frequency characteristics, delay time and reverberation characters, set by the user for each of the selectable tone colors. With such arrangements, the tone signals generated by the tone generator section 42** can be adjusted to acoustic characteristics as desired by the user, for each of the selectable tone colors (i.e., on a tone-color-by-tone-color basis).

Further, in the electronic keyboard instrument 10, an assignment section 50 includes mixing amplifier units 68, 70, 72, 74, 76, 78, 80 and 82 provided in corresponding relation to speaker reproduction systems 52, 54, 56, 58, 60, 62, 64 and vibrator drive system 66. The mixing amplifier units 68, 70, 72, 74, 76, 78, 80 and 82 includes sets of tone volume adjusting elements (attenuators) 68-1, 68-2, . . . , **68-*n*, 70-1, 70-2, . . . , 70-*n*, 80-1, 80-2, . . . , 80-*n*, and 82-1, 82-2, . . . , 82-*n* in corresponding relation to the tone source channels 44-1, 44-2, . . . , 44-*n*. Each of the tone volume adjusting element sets (attenuator sets) 68-1, 68-2, . . . , 68-*n*, 70-1, 70-2, . . . , 70-*n*, . . . , . . . , or 82-1, 82-2, . . . , 82-*n* is adjusted to a tone volume allocation set by the user in accordance with a combination of the tone colors and corresponding speaker 16-28 or vibrator 30. Thus, each of the tone volume adjusting element sets controls the tone signals of the individual tone source channels 44-1, 44-2, . . . , 44-*n* to take the allocated tone volume set for a corresponding one of the speaker reproduction systems 52, 54, 56, 58, 60, 62, 64 and vibrator drive system 66. In this way, it is possible to adjust horizontal sound image localization, sense of depth, sense of expansion, etc. of a tone, for each of the selectable tone colors. Namely, in the electronic keyboard instrument 10, the horizontal sound image localization of a tone can be set in accordance with a relationship in level between the tone volume allocations of the left and right front speakers 16 and 18. Particularly, the sense of depth of the tone can be enhanced by increasing the tone volume allocations to the rear speakers 20 and 22, and the sense of expansion of the tone can be enhanced by increasing the tone volume allocations to the upper speakers 24 and 26. Further, by increasing the tone volume allocation to the vibrator 30, vibrations of the casing 12** and floor can be enhanced in synchronism with a performance.

Each of the mixing amplifier units 68, 70, 72, 74, 76, 78, 80 and 82 mixes the tones signals of the individual tone source channels, having tone volumes adjusted by means of its tone volume adjusting elements 68-1, 68-2, . . . , **68-*n*, 70-1, 70-2, . . . , 70-*n*, . . . , or 82-1, 82-2, . . . , 82-*n*, using its amplifier 68*a*, 70*a*, 72*a*, 74*a*, 76*a*, 78*a*, 80*a* or 82*a*, and it delivers the thus-mixed tone signals to the corresponding speaker reproduction system 52, 54, 56, 58, 60, 62, 64 or vibrator drive system 66**.

Further, in the electronic keyboard instrument 10, a second tone parameter impartment section 84 includes tone parameter imparting units 86, 88, 90, 92, 94, 96, 98 and 100 provided in corresponding relation to the speaker reproduction systems 52, 54, 56, 58, 60, 62, 64 and vibrator drive system 66. The second tone parameter impartment section 84 imparts the tone signal of each of the speaker reproduction systems 52, 54, 56, 58, 60, 62, 64 and vibrator drive system 66 with tone parameters, such as parameters of frequency characteristics, delay time and reverberation characteristics set by the user for the corresponding speaker 16, 18, 20, 22, 24, 26, 28 or vibrator 30. Thus, for each desired one of the speakers 16, 18, 20, 22, 24, 26, 28 and vibrator 30, it is possible to adjust the tone signals to acoustic characteristics desired by the user. Note that the parameter imparting unit 100 of the vibrator 30 may be constructed to have frequency characteristics to particularly extract low-frequency components of the tone signals. The tone signals of the speaker reproduction systems 52, 54, 56, 58, 60, 62, 64 and vibrator drive system 66, having been imparted with the tone parameters, are passed to corresponding attenuators 102, 104, 106, 108, 111, 113, 115 and 117, where the tones volumes of the individual reproduction and rive systems and the total tone volume of all the tones are adjusted. The thus volume-adjusted tone signals are then supplied to the speakers 16, 18, 20, 22, 24, 26, 28 and vibrator 30, respectively, via corresponding power amplifiers 119, 121, 123, 125, 127, 129, 131 and 133.

When, in the electronic keyboard instrument 10 arranged in the above-described manner, the user manipulates the operation panel 15 to select one or more desired tone colors (e.g., one or more desired types of musical instruments), for example, for each predetermined pitch range—if the instrument 10 includes an upper keyboard, lower keyboard and foot pedal, the user can select a desired tone color separately for each of the upper keyboard, lower keyboard and foot pedal—, one or more of the switches 46-1, 46-2, . . . , **46-*n* provided in the tone source channels 44-1, 44-2, . . . , 44-*n*, which correspond to the selected tone colors, are turned on so that tone signals of the selected tone colors are supplied via the turned-on switches to the first tone parameter impartment section 48 in response to a performance by the human player or in accordance with an automatic performance program. The first tone parameter impartment section 48 imparts the supplied tone signals with tone parameters (such as parameters of frequency characteristics, delay time and reverberation characteristics) individually set for the selected tone colors. The tone signals thus imparted with the tone parameters are adjusted to tone volume allocations, individually set for respective combinations of the tone colors and speakers 16, 18, 20, 22, 24, 26, 28 and vibrator 30, by means of a matrix formed by the tone volume adjusting elements 68-1, . . . 82-*n* of the assignment section 50, and then mixed together for each of the speaker reproduction systems 52, 54, 56, 58, 60, 62, 64 and vibrator drive system 66. The thus mixed tone signals are supplied to the second tone parameter impartment section 84, which imparts the supplied tone signals with tone parameters (e.g., parameters of frequency characteristics, delay time and reverberation characteristics) set for each of the speaker reproduction systems 52, 54, 56, 58, 60, 62, 64 and vibrator drive system 66. The tone signals having been thus imparted with the tone parameters are adjusted in tone volume via the corresponding attenuators 102, 104, 106, 108, 111, 113, 115 and 117 and supplied via the power amplifiers 119, 121, 123, 125, 127, 129, 131 and 133 to the speakers 16, 18, 20, 22, 24, 26, 28 and vibrator 30, respectively, for audible reproduction or vibration. In this manner, the tone signals based on the performance by the human player (or automatic performance program) can be audibly reproduced or sounded with horizontal sound image localization, sense of depth and sense of expansion set separately for each of the selected tone colors, and vibrations of the casing 12 and floor can also be obtained by driving the vibrator 30** in synchronism with the performance.

TABLE 1 below shows example settings of tone volume allocations set in the assignment section 50 on the tone-color-by-tone-color basis.

TABLE 1

| | Speaker | | | | |
|---|---|---|---|---|---|
| Tone Color | Left & Right Front | Left & Right Rear | Left & Right Upper | Woofer | Vibrator |
| Piano | 20% | 20% | 20% | 20% | 20% |
| Organ | 40% | 10% | 30% | 10% | 10% |
| Flute | 25% | 25% | 50% | Off | Off |

According to the settings of TABLE 1, the left and right rear speakers 20, 22 and the left and right upper speakers 24, 26 are allocated the same tone volume of the piano tone color as the left and right front speakers 16, 18, and thus it is possible to provide a sense of depth and sense of expansion close to those of a real grand piano. Also, vibrations of the casing 12 and floor close to those of a real grand piano can be provided in synchronism with a performance. Further, the left and right upper speakers 24, 26 are allocated a tone volume of the organ tone color close to that allocated to the left and right front speakers 16, 18, so that it is possible to provide a sense expansion close to that of a real organ. Also, vibrations of the casing 12 and floor close to those of a real organ can be provided in synchronism with a performance. Further, the left and right upper speakers 24, 26 are allocated a tone volume of the flute tone color twice as great as that allocated to the left and right front speakers 16, 18, so that it is possible to provide a sense of expansion close to that of a real flute. Further, because the left and right rear speakers 20, 22 are allocated the same tone volume of the flute tone color as the left and right front speakers 16, 18, it is possible to provide a sense depth close to that of a real flute. Although the left and right channels of each of the front speakers 16, 18, rear speakers 20, 22 and upper speakers 24, 26 are set to the same tone volume allocation according to TABLE 1, the tone volume allocation of the left and right channels of each of these speakers may be differentiated from each other so that the horizontal sound image localization can be set separately for each of the left and right channels.

Whereas the front speakers 16 and 18 are positioned on the front surface 12*a* of the casing 12 above the keyboard 14 in the above-described embodiment, they may be positioned on the front surface 12*a* of the casing 12 below the keyboard 14 or above the upper surface 12*d* of the casing 12. Further, the non-front speakers may be disposed on side surfaces 12*e* and 12*f* or the like of the casing 12, in addition to or in place of those positions specified in relation to the described embodiment.

The present invention relates to the subject matter of Japanese Patent Application No. 2001-400384 filed Dec. 28, 2001, the disclosure of which is expressly incorporated herein by reference in its entirety.

What is claimed is:

1. A tone reproduction method for an electronic keyboard instrument comprising the steps of:

providing a front speaker in an orientation facing a human player and a non-front speaker in an orientation not facing the human player;

setting tone volume allocations to be applied to individual ones of said speakers, separately for each of a plurality of tone source channels that generate tone signals of respective tone colors;

assigning the tone signals of individual ones of said tone source channels to respective reproduction systems of said speakers, with the tone volume allocations set by said step of setting; and mixing the tone signals of the individual tone source channels, assigned to the reproduction systems, separately for each of the reproduction systems of said speakers and audibly reproducing the mixed tone signals via corresponding ones of said speakers.

2. An electronic keyboard instrument comprising:

a front speaker provided in an orientation facing a human player;

a non-front speaker provided in an orientation not facing the human player;

a tone generator section that generates tone signals of respective tone colors through a plurality of tone source channels;

an assignment section that assigns the tone signals of individual ones of said tone source channels to respective reproduction systems of said speakers, with tone volume allocations set individually for the reproduction systems; and a mixing section that mixes the tone signals of the individual tone source channels, assigned to the reproduction systems, separately for each of the reproduction systems of said speakers and supplies the mixed tone signals to corresponding ones of the reproduction systems of said speakers.

3. An electronic keyboard instrument as claimed in claim 2 wherein said front speaker includes left and right front speakers provided on a front surface of a casing of said electronic keyboard instrument.

4. An electronic keyboard instrument as claimed in claim 2 wherein said non-front speaker includes a rear speaker provided on a rear surface of the casing and facing rearwardly of said electronic keyboard instrument.

5. An electronic keyboard instrument as claimed in claim 2 wherein said non-front speaker includes an upper speaker provided on an upper surface of the casing and facing upwardly of said electronic keyboard instrument.

6. An electronic keyboard instrument as claimed in claim 2 which further comprises a woofer speaker provided in an orientation facing the human player, and wherein said assignment section assigns the tone signals of the individual tone source channels to a reproduction system of said woofer speaker with a tone volume allocation separately set for the reproduction system of said woofer speaker, and said mixing section mixes the tone signals assigned to the reproduction system of said woofer speaker and to supplies the mixed tone signals to the reproduction system of said woofer speaker.

7. An electronic keyboard instrument as claimed in claim 2 which further comprises a storage section that, for each tone color generatable by said tone generator section, stores tone volume allocations of tone signals to be applied to individual ones of the reproduction systems of said speakers, and wherein, for each of the tone source channels generating tone signals of respective tone colors, said assignment section read outs the stored tone volume allocations to be applied to the individual reproduction systems of said speakers, from said storage section, in response to a predetermined readout instruction and then sets the read-out tone volume allocations as the tone volume allocations to be applied to the individual reproduction systems of said speakers.

8. An electronic keyboard instrument as claimed in claim 7 which further comprises a tone-volume-allocation modification section that modifies, separately for each designated one of the tone source channels, the tone volume allocations set in said assignment section in response to predetermined modifying operation by a user.

9. An electronic keyboard instrument as claimed in claim 8 wherein said storage section stores each of the tone volume allocations modified by said tone-volume-allocation modification section, and said assignment section, for each of the tone source channels generating tone signals of respective tone colors, reads out the tone volume allocations stored in said storage section in response to a predetermined readout instruction and sets the read-out tone volume allocations as the tone volume allocations to be applied to the individual reproduction systems of said speakers.

10. An electronic keyboard instrument as claimed in claim 2 which further comprises a vibrator provided on a casing of said electronic keyboard instrument, and wherein said assignment section assigns the tone signals of the individual tone source channels to a drive system of said vibrator with tone volume allocations separately set for the drive system of said vibrator, and said mixing section mixes the tone signals of the individual tone source channels assigned by said assignment section to the drive system of said vibrator and supplies the mixed tone signals to the drive system of said vibrator.

11. An electronic keyboard instrument as claimed in claim 2 which further comprises a tone parameter impartment section that imparts respective predetermined tone parameters to the tone signals of the individual tone source channels, and wherein said assignment section assigns the tone signals of the individual tone source channels, having been imparted with the respective predetermined tone parameters by said tone parameter impartment section, to the corresponding reproduction systems of said speakers with the tone volume allocations set individually for the reproduction systems of said speakers.

12. An electronic keyboard instrument as claimed in claim 2 which further comprises a second tone parameter impartment section that imparts respective predetermined tone parameters to the tone signals of the individual reproduction systems of said speakers having been mixed by said mixing section.

13. An electronic keyboard instrument as claimed in claim 2 which further comprises a tone volume adjustment section that individually adjusts tone volumes of the tone signals of the reproduction systems of said speakers having been mixed by said mixing section.

14. An electronic keyboard instrument as claimed in claim 11 wherein the predetermined tone parameters to be imparted to a tone signal of each of said tone source channels include parameters of any one or more of a frequency characteristic, delay time and reverberation characteristic.

* * * * *